United States Patent [19]

Eissenberg et al.

[11] 4,212,651

[45] Jul. 15, 1980

[54] HIGH GRADIENT MAGNETIC BENEFICIATION OF DRY PULVERIZED COAL VIA UPWARDLY DIRECTED RECIRCULATING FLUIDIZATION

[75] Inventors: David M. Eissenberg, Oak Ridge, Tenn.; Yin-An Liu, Opelika, Ala.

[73] Assignee: The United States of America as represented by the United States Department of Energy, Washington, D.C.

[21] Appl. No.: 43,875

[22] Filed: May 30, 1979

[51] Int. Cl.[2] ..... C10L 9/10; B03C 1/00

[52] U.S. Cl. ..... 44/1 SR; 55/3; 55/100; 209/38; 209/214; 209/223 R; 209/232

[58] Field of Search ..... 44/1 SR; 55/3, 100; 209/38, 214, 223 R, 232; 75/6

[56] References Cited

U.S. PATENT DOCUMENTS

| | | | |
|---|---|---|---|
| 3,380,589 | 4/1968 | Gray | 55/100 X |
| 4,052,170 | 10/1977 | Yan | 44/1 SR |
| 4,081,251 | 3/1978 | Colli | 44/1 SR |

FOREIGN PATENT DOCUMENTS 758178 10/1956 United Kingdom ..... 209/38

OTHER PUBLICATIONS

Watson, J. H. P., Application of and Improvements in HGMS, Filtration & Separation, Mar./Apr. 1979, vol. 16, No. 2, pp. 140–141.

*Primary Examiner*—Carl F. Dees

*Attorney, Agent, or Firm*—R. V. Lupo; Stephen D. Hamel

[57] ABSTRACT

This invention relates to an improved device and method for the high gradient magnetic beneficiation of dry pulverized coal, for the purpose of removing sulfur and ash from the coal whereby the product is a dry environmentally acceptable, low-sulfur fuel. The process involves upwardly directed recirculating air fluidization of selectively sized powdered coal in a separator having sections of increasing diameters in the direction of air flow, with magnetic field and flow rates chosen for optimum separations depending upon particulate size.

8 Claims, 4 Drawing Figures

HIGH GRADIENT MAGNETIC BENEFICIATION OF DRY PULVERIZED COAL VIA UPWARDLY DIRECTED RECIRCULATING FLUIDIZATION

BACKGROUND OF THE INVENTION

This invention was made in the course of, or under, a contract with the U.S. Department of Energy.

High gradient magnetic separation (HGMS) is a relatively new technology which provides a practical means for separating micron-size, weakly magnetic materials on a large scale at high flow rates. The technology is also applicable to separating nonmagnetic materials which can be made to associate with magnetic seeding materials. HGMS was developed in 1969 for the wet separation of weakly magnetic contaminants from kaolin clay as published from *IEEE Transactions on Magnetics,* Vol. Mag-10, No. 2, June 1974, pp. 223–238, entitled "Magnetic Separation: A Review of Principles, Devices, and Applications." A typical HGMS unit for this existing commercial application utilizes an iron-clad solenoidal magnet structure consisting of water-cooled energizing coils and a surrounding iron enclosure. The coils in turn enclose a cylindrical separator working volume packed with fine strands of strongly ferromagnetic packing materials such as ferritic stainless steel wool. With this design, a strong field intensity of up to 20 kOe (kilo-Oersted) is generated and distributed uniformly throughout the separator working volume. Furthermore, by placing the ferromagnetic packing materials with many sharp edges (which increase and distort the field in their vicinity) in the uniform field, large field gradients of the order of 1–10 kOe/$\mu$m are produced almost everywhere in the separator working volume.

Because of its very low costs and outstanding technical performance demonstrated in the kaolin application, HGMS is being adapted to solving many separation problems related to minerals and chemical processing industries. For example, reference is made to an article published in *IEEE Transactions on Magnetics,* Vol. Mag-12, No. 5, pp. 428–435, September 1976 by Oder, R. R., entitled "High Gradient Magnetic Separation: Theory and Applications"; and to a recent state-of-the-art reference book edited by Y. A. Liu, entitled *Industrial Applications of Magnetic Separation* (IEEE Publication No. 78 CH1447-2 MAG) published by the Institute of Electrical and Electronic Engineers, Inc. (IEEE), New York, New York in April 1979. An important and promising application of HGMS is the magnetic removal of inorganic sulfur and ash from coal. Previous experimental investigations have indicated clearly that most of the mineral impurities in coal, which contribute to its pyritic sulfur, the sulfate sulfur and the ash content, are paramagnetic. These sulfur-bearing and ash-forming minerals, if sufficiently liberated as discrete particles, can be separated from the pulverized diamagnetic coal by magnetic means, as reported by S. Ergun et al., *Report of Investigation, No.* 7181, U.S. Bureau of Mines, 1968, entitled "Magnetic Separation of Pyrite from Coals"; and by Y. A. Liu and C. J. Lin, *IEEE Transactions on Magnetics,* Vol. Mag-12, No. 5, pp. 538–550, September 1976, entitled "Assessment of Sulfur and Ash Removal from Coals by Magnetic Separation."

HGMS was recently adapted successfully in a bench-scale exploratory study to remove sulfur and ash from a finely pulverized Brazilian coal suspended in water as reported by S. C. Trindade in his *Ph.D Thesis* submitted to the Department of Chemical Engineering, Massachusetts Institute of Technology, Cambridge, Massachusetts, 1973, entitled "Studies on the Magnetic Demineralization of Coal." Since then, other investigators have utilized laboratory-scale HGMS units to desulfurize and deash water slurries of several pulverized Eastern U.S. coals as reported by Y. A. Liu and C. J. Lin, ibid., by F. E. Luborsky, Technical Reports issued by the General Electric Corporate Research and Development to the U.S. Bureau of Mines under Contract No. HO 366008, February 1977, and September 1977, entitled "High Gradient Magnetic Separation for Removal of Sulfur from Coal"; and by H. H. Murray, *IEEE Transactions on Magnetics,* Vol. Mag-12, No. 5, pp. 498–502, September 1976, entitled "Beneficiation of Selected Industrial Minerals and Coal by High Intensity Magnetic Separation."

Because of the necessary costs of drying and dewatering the products in the magnetic beneficiation of coal/water slurry, it was generally believed that the most economical application of HGMS to coal beneficiation would be the dry separation of sulfur and ash from pulverized coal. The application of HGMS to remove sulfur and ash from dry pulverized coal has just been initiated recently. Much of the work reported thus far has been limited to investigating the technical feasibility of magnetic beneficiation of dry pulverized coal via either gravity feeding or downwardly directed air-entrained separation. The simplest way for feeding dry pulverized coal to a HGMS unit is by gravity. Preliminary results on the magnetic desulfurization of dry pulverized Indiana No. 5 and 6 coals (−200 mesh) by HGMS via gravity feeding, reported, by H. H. Murray, ibid., have shown that the weight percent of sulfur removed from dry pulverized coal was at most 20% even with multiple-pass separation. A comparison was made between the results obtained by dry and wet beneficiation. No reasons were evident as to why wet beneficiation was substantially more effective in sulfur removal compared to dry separation with gravity feeding.

Experimental results obtained from a related study of dry beneficiation of pulverized coal by HGMS via vibration-assisted gravity feeding have been reported in the above-mentioned Technical Reports by F. E. Luborsky. A combination of mechanical and electromagnetic vibrations was employed to assist the gravity feeding of the dry pulverized coal into the HGMS unit. The unit was used for the beneficiation of a Pennsylvania Upper Freeport coal from the Delmont mine. Average contents of ash, total sulfur, and pyrite sulfur of the coal used were 14.6, 1.55, and 0.75 wt.%, respectively. At a reasonable field intensity of 20 kOe, sulfur removal was, at the most, about 26.4%. As above, the observed sulfur removal was less than that from magnetic beneficiation of a coal/water slurry.

Prior to the present invention, the only experimental investigation of the magnetic beneficiation of dry pulverized coal via air entrainment was that described in the above-mentioned Technical Reports by F. E. Luborsky to the U.S. Bureau of Mines. In that study, a screw or vibratory feeder was used to inject a dry pulverized Upper Freeport coal from Westmoreland County, Pennsylvania, into an air stream which carried it downward through a separator matrix of 1-inch I.D. and 6-inch length. The preliminary tests with a screw feeder and an expanded metal matrix shows that the presence of fines in the typically 60-mesh feed coal would make the feeder inoperative; and no significant reduction in the sulfur and ash of the produce coal was observed. Subsequent tests conducted using a vibratory feeder with the field intensity up to 50 kOe and air velocities of 59–1,019 cm/sec indicated that the weight percent of sulfur removed from the feed coal was very small and irregular, rarely more than 20%. By contrast, experiments carried out with the same coal in a water slurry showed that HGMS was effective in removing the total sulfur of the feed coal by 50%, the ash by 50%, and the pyrite by 60–80%. This comparison suggested that HGMS applied to the beneficiation of dry pulverized coal via downflow air-entrained separation might not be technically feasible. No definite reasons regarding the above significant difference in the performance of dry and wet beneficiation of pulverized coal were given in this reported study; although it was suggested that the presence of fines might impede magnetic beneficiation due to their promotion of the agglomeration of coal and pyrite particles.

Thus, there exists a need for new techniques for feeding dry pulverized coal into a HGMS unit and to provide means for achieving improved beneficiation so that the product is a dry environmentally acceptable, low-sulfur fuel. The present invention was conceived to meet this need in a manner to be described below.

SUMMARY OF THE INVENTION

It is the object of the present invention to provide an improved means and method for the removal of inorganic sulfur and ash form dry pulverized coal wherein the removal of magnetic sulfur-bearing and ash-forming minerals from the total coal/air stream is substantially enhanced so as to achieve the desired beneficiation.

The above object has been accomplished in the present invention by providing a HGMS unit utilizing an upflow air fluidization in the unit which is constructed in such a manner as to provide some recirculation therein to bring coal particles of a limited size range repeatedly into contact with a magnetized packing material thereby enhancing the removal of magnetic sulfur-bearing and ash-forming minerals from the total coal/air stream so as to achieve the desired beneficiation.

DESCRIPTION OF THE PREFERRED EMBODIMENT

To be successful, a magnetic separator for dry pulverized coal must include two essential features. First, it must have a simple means to remove fines from the fluidized coal stream and to avoid their possible agglomeration in the separator matrix. Secondly, it must provide a sufficient retention time to the fluidized coal stream to promote the contact between the magnetic particles in the coal and the active surface area in the separator matrix. The latter is of importance in increasing the capacity of the separator matrix for capturing and retaining the magnetic particles in the feed coal.

Figure 2:
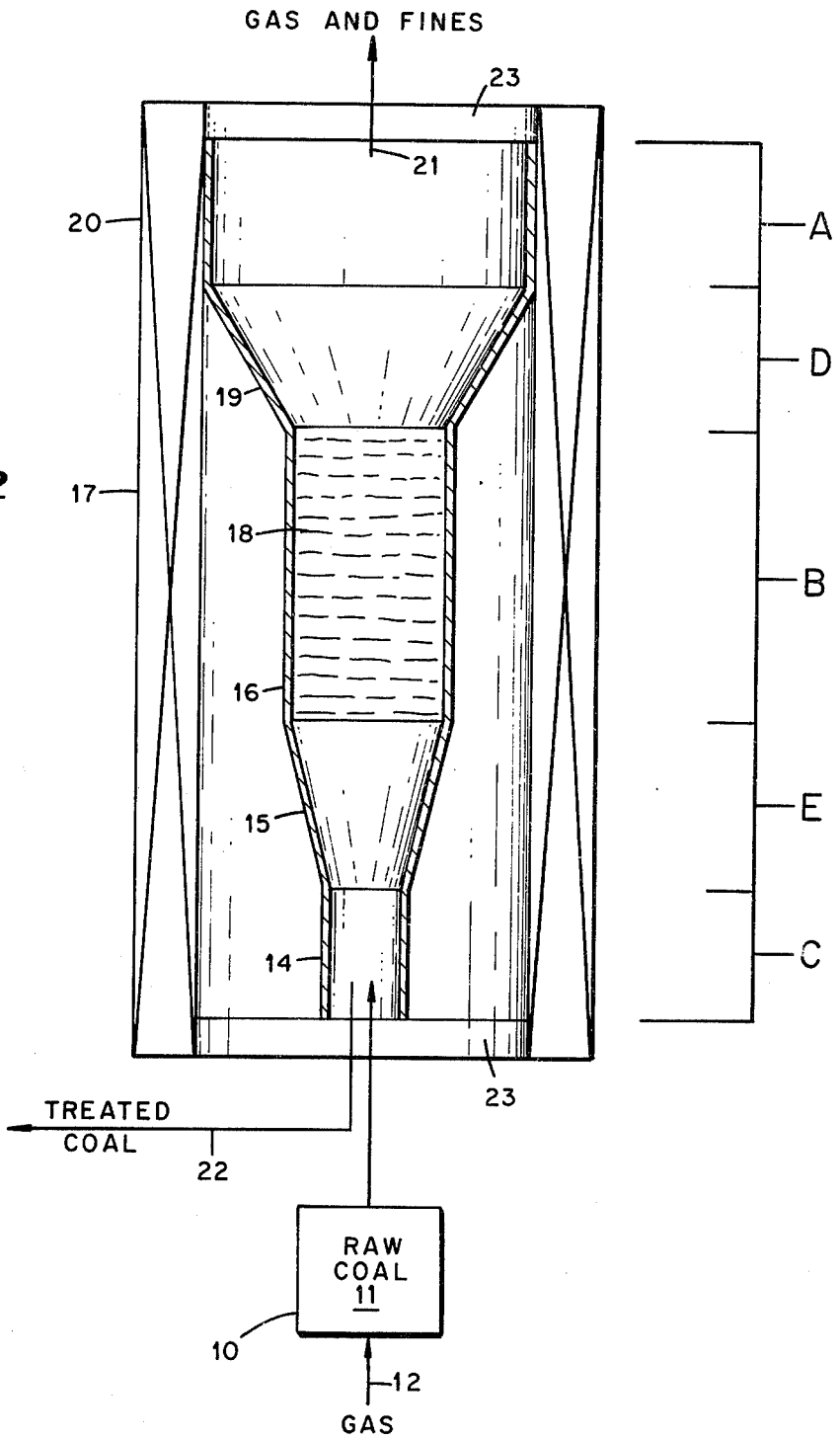
FIG. 2 is a cross section of one preferred embodiment of a high gradient magnetic separator of the present invention.

Accordingly, a batch HGMS unit is provided in the present invention to achieve the above two essential features and such a unit is illustrated in FIG. 2 of the drawings which will be described below.

Figure 1:
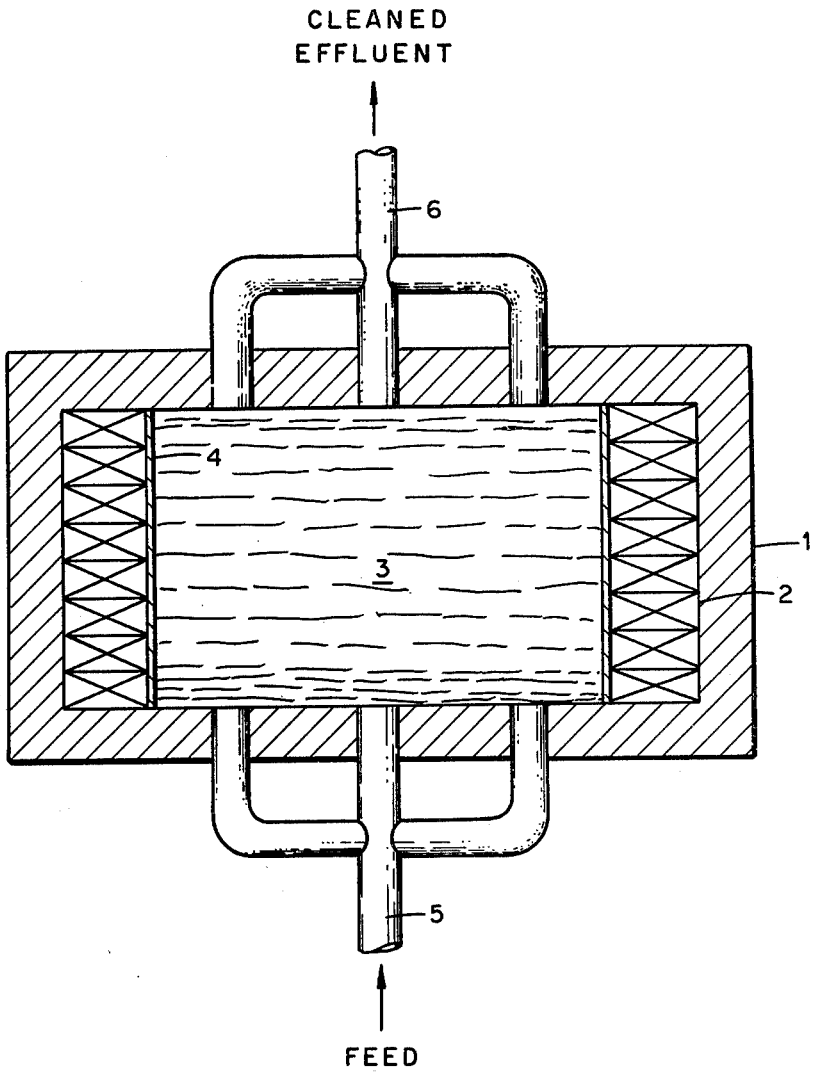
PRIOR ART Fig. 1
FIG. 1 is a cross section of a high gradient magnetic separator as used in the prior art.

A prior-art upflow, HGMS unit is illustrated in FIG. 1 of the drawings for comparison. The unit of FIG. 1 was described in the above-mentioned paper by R. R. Oder in *IEEE Transactions on Magnetics,* Vol. Mag-12, No. 5, pp. 428–435, September 1976. The unit of FIG. 1 was developed for the wet beneficiation of quality-grade kaolin clay, and comprises an iron box 1 which encloses energizing coils 2. The coils 2 in turn enclose a cylindrical, highly magnetized working volume 4 into which are loosely packed fine strands of filamentary magnetic material 3 such as stainless wool. The wet coal slurry is fed into the working chamber 4 by means of a feed tube 5, and the cleaned effluent is fed from the chamber 4 by means of an exit tube 6. The above paper of R. R. Oder also discusses a prior-art HGMS unit for the beneficiation of dry pulverized coal on pp. 433–434 and sets forth the possible problems associated therewith, one of which is poor flow distribution of which the present invention was conceived to overcome by the device set forth in FIG. 2 of the drawings which will now be described.

In FIG. 2, the magnetic separator matrix unit is made of three primary sections A, B, and C of decreasing inside diameters arranged from the top to the bottom. Section A is provided with an inside diameter of 5 inches and is 3 inches long; section B is provided with an inside diameter of 3.5 inches and is 10 inches long; and section C is provided with an inside diameter of 0.75 inch and is 7 inches long, for example. A tapered joining section D, 3 inches long, is provided between the sections A and B, and a tapered joining section E, 4 inches long, is provided between the sections B and C. Section A is designated by reference numeral 20, section D by reference numeral 19, section B by reference numeral 16, section E by reference numeral 15, and section C by reference numeral 14. Magnet coils 17, connected to a movable pair of pole pieces 23 and to a power supply, not shown, encircle the unit and section B contains packing material 18 (matrix) such as stainless steel screens, e.g., 40 screens with spacers. It should be understood that the magnetic separator is not limited to the above dimensions and the unit could be made proportionally larger if such is desired.

The pulverized feed coal 11, is placed in a feed chamber 10 outside of the separator and is adapted to be air transported as at 13 into the section 14 of the separator by means of a gas 12. By properly controlling the flow velocity of the air (gas) stream during the whole separation period, it was possible to selectively elutriate most of the fines 21 in the pulverized coal stream out of the top of the bed and to collect it as a top product. At the same time, because of the unique expanded sections from the bottom to the top of the separator matrix and the resulting gradual decrease in the upward fluidization velocity of the pulverized coal stream, the majority of the pulverized coal particles of medium and large sizes tended to recirculate inside the central section B containing the packing matrix 18. As a result, a sufficient retention time inside the separator was provided to the bulk of the fluidized coal stream without the presence of fines, thus allowing the magnetic particles in the coal to be captured and retained by the matrix. Toward the end of the desired separation period, the flow velocity of the air (gas) stream was reduced allowing magnetically beneficiated coal of low sulfur and ash contents to be removed by gravity as a clean coal product 22. Following this, the magnetic field provided by the magnet coils 17 was turned off and the high-sulfur, high-ash residue was collected as a waste product.

The following Table shows the typical experimental results obtained with the device of FIG. 2 with a Pennsylvania Upper Freeport coal of particle sizes between 100 and 200 mesh and fluidization time of 10 minutes using stainless steel screens as matrix packing. The air velocity was 17.7 cm/sec, for example, which was adequate to achieve good fluidization characteristics of the coal/air stream in the magnetic separation unit.

TABLE

Composition of Feed And Of Separated Fractions

| | | Grams | Percent Total Sulfur | Percent Pyritic Sulfur | Percent Ash |
|---|---|---|---|---|---|
| 1. | Feed | 100.00 | 2.123 | 1.519 | 6.320 |
| 2. | Mags (20 KOe) | | | | |
| | 1st-pass | 9.05 | 12.80 | 11.79 | 24.87 |
| | 2nd-pass | 5.99 | 4.68 | 4.18 | 13.26 |
| | 3rd-pass | 5.12 | 2.25 | 1.93 | 10.00 |
| | total | 20.16 | 7.71 | 7.02 | 17.65 |
| 3. | Total tails[b] (20 KOe) | 79.84 | 0.68 | 0.130 | 3.45 |
| 4. | Feed separared as mags | 20.16 | 68.16[a] | 86.80[a] | 52.43[a] |
| 5. | Mags (O KOe) | 5.03 | 1.35 | 0.85 | 4.66 |

[a]weight percent of sulfur, pyritic sulfur or ash separated from feed as mags
[b]Tails = beneficiated products from the separator
[c]Mags = captured magnetic materials As can be seen from the above Table, by passing coal samples through the unit three times in series (3-pass separation), it was possible to reduce the total sulfur of the feed coal by 68.16%, the pyrite by 86.8%, and the ash by 52.43%. The total sulfur content of the magnetically beneficiated coal was 0.68 wt.%. These results were easily reproduced in repeated runs under the same conditions. Thus, it can be seen that the magnetically beneficiated, sized Upper Freeport coal obtained in the operation of the FIG. 2 device could be used immediately as a dry, environmentally acceptable, low-sulfur fuel, and that the results set forth in the above Table clearly demonstrate that the device of FIG. 2 produces a magnetically beneficiated dry coal with low sulfur and ash contents that is a substantial improvement over that achievable in the prior art as discussed in the above Background of the Invention.

In addition to the above results, it has been determined that 90.0%, 84.2%, and 81.6% of the inorganic sulfur could be removed magnetically with the device of FIG. 2 from dry pulverized Pennsylvania, Upper Kittanning, Lower Freeport, and Upper Freeport coals, respectively. The coal particle sizes were between 100 and 200 mesh, amount of feed coal was 100 grams, with a magnetic field of 18 kOe, 3 passes, fluidization time of 5 minutes, and an air velocity of 17.7 cm/sec. These results are comparable to those presented in the above Table.

From the Table and the above additional results, it can be seen that the extents of magnetic removal of sulfur and ash from dry pulverized coal can be even better than that achievable when a coal/water slurry is beneficiated in a HGMS unit as reported in the above prior art references.

Nearly as good beneficiation occurs using a magnetic field of 10 kOe. This potentially reduces the magnet power consumption by at least a factor of 4. Other operating conditions investigated were coal particle size, fluidization time and matrix packing material. A limited range, e.g., 60–100 mesh or 100–200 mesh, sulfur removal was about the same for either range. While sulfur removal increased slightly with fluidization time for a single pass, there was little difference between 5 and 10 minutes for three-pass operation. An expanded metal matrix was found to provide improved beneficiation as compared to the screens fabricated from metal strips.

Figure 3:
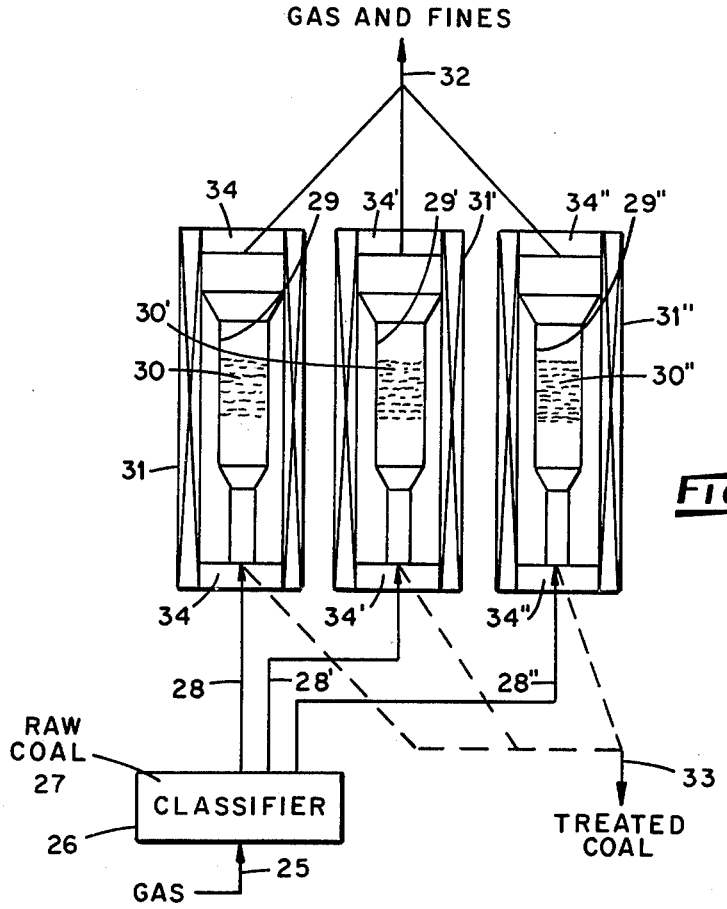
FIG. 3 is a schematic diagram of an embodiment of the present invention for a large-scale coal handling facility.

Referring now to FIG. 3 of the drawings, there is illustrated a batch system wherein three of the HGMS units such as described in FIG. 2 are operated in parallel with each processing pulverized feed coal of a selected particle size range.

In FIG. 3, pulverized raw coal 27 in the classifier 26 is fed by means of the feed lines 28, 28' and 28" to the respective HGMS units 29, 29' and 29" by means of a gas 25. The fines from the three units 29, 29' and 29" are collected in a common output line 32. The units 29, 29' and 29" are encompassed with respective magnet coils 31, 31' and 31", and movable pairs of pole pieces 34, 34' and 34". Each unit is packed with respective stainless steel screens, 30, 30' and 30". The treated coal is collected in a common output line 33.

Figure 4:
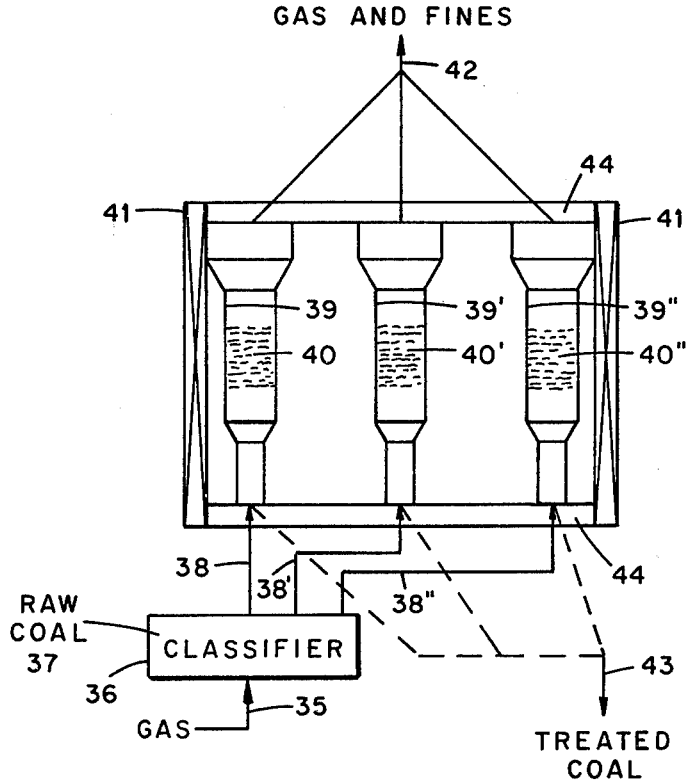
FIG. 4 is a schematic diagram of another embodiment of the present invention for a large-scale coal handling facility.

FIG. 4 illustrates a further embodiment of the present invention, wherein three HGMS units are mounted within the same cylindrical core of a solenoidal magnet. In FIG. 4, the classifier 36 containing pulverized raw coal 37 has connected thereto a gas feed line 35 for effecting the feeding of the coal therefrom of a selected particle size range through the respective feed lines 38, 38' and 38" to the respective magnetic separators 39, 39' and 39". The fines are collected by means of a common output line 42. The units 39, 39' and 39" are contained within the same cylindrical core of a solenoidal magnet 41 equipped with a movable pair of pole pieces 44. The treated coal is collected in a common output line 43.

It should be understood that in either of the embodiments of FIGS. 3 and 4, duplicate equipment, not shown, could be provided such that one set could be unloaded after beneficiation of a particular quantity of coal has been completed, while the other set is being utilized to effect the beneficiation of a different batch of coal.

This invention has been described by way of illustration rather than by limitation and it should be apparent that it is equally applicable in applications other than those described.

What is claimed is:

1. An improved system for the efficient removal of sulfur and ash from dry pulverized raw feed coal comprising a feed chamber containing said coal; a high gradient magnetic separation unit mounted above said feed chamber, said unit comprising a first cylindrical section of a selected diameter and spaced from said feed chamber, a second cylindrical section spaced from and having a selected diameter larger than said first section, a first hollow tapered section connecting said first and second cylindrical sections, a third cylindrical section spaced from and having a selected diameter larger than said second section, a second hollow tapered section connecting said second and third cylindrical sections, an iron-clad solenoidal magnet equipped with a movable pair of pole pieces encompassing said cylindrical and hollow tapered sections and adapted to be connected to a power supply, a matrix of magnetic packing material mounted within the interior of said second cylindrical section; and a source of feed gas connected to said feed chamber and adapted to be fed thereto at a selected flow velocity for effecting the air-transportation of said feed coal upwardly into said separation unit for a predetermined time, whereby in the operation of said system during said time, the fines and a portion of said feed gas are collected as a top product out from the top of said third cylindrical section, a sufficient retention time for the efficient removal of magnetic particles from said coal is effected inside of said second cylindrical section to the bulk of the fluidized coal stream due to the gradual decrease in the upward fluidization velocity of the coal stream effected by the expanded sections from the bottom to the top of said separation unit thereby effecting a substantial capturing and retention of the magnetic particles in said coal by said matrix, and after said time has expired said flow velocity of said feed gas is adapted to be reduced thus allowing the magnetically beneficiated coal of low sulfur and ash content to be removed from said unit by gravity as a clean coal product after which the magnetic field is adapted to be cut off and the high-sulfur and high-ash residue collected as a waste product from said matrix.

2. The system set forth in claim 1, wherein said matrix is comprised of stainless steel screens with spacers.

3. The system set forth in claim 2, wherein said predetermined time is of a selected value up to 10 minutes, and said gas flow velocity is chosen to achieve good fluidization characteristics of the coal/air stream in the said high gradient magnetic separation unit.

4. The system set forth in claim 2, wherein a coal classifier is substituted for said feed chamber with said source of feed gas connected thereto, two additional high gradient magnetic separation units identical to said first unit are provided with all three of said units adapted to be operated in parallel with three respective inputs of fluidized feed coal being fed thereto from said classifier.

5. The system set forth in claim 4, wherein said three separation units are adapted to be encompassed by a single, common iron-clad solenoidal magnet.

6. An improved method for the efficient removal of sulfur and ash from dry pulverized raw feed coal comprising the steps of feeding a gas through a coal feed chamber to provide a fluidized stream of said feed coal at a selected flow velocity and for a predetermined time upwardly into an iron-clad solenoidal magnetic separation unit equipped with a movable pair of pole pieces and provided with three expanded hollow sections from the bottom to the top thereof with the central section containing a magnetic packing material therewithin, said expanded sections providing a gradual decrease in the upward fluidization velocity of the pulverized coal stream to provide a sufficient retention time within said separation unit to effect a substantial capturing and retention of the magnetic particles in said coal by said matrix, collecting the fines and a portion of said gas out of the top of said unit as a top product during said time, reducing the flow velocity of the gas after said time has expired and collecting by gravity the magnetically beneficiated coal of low sulfur and ash contents from said unit as a clean coal product, and turning off said electromagnet and collecting the high-sulfur and high-ash residue from said matrix as a waste product.

7. The method set forth in claim 6, wherein said matrix is comprised of stainless steel screens with spacers.

8. The method set forth in claim 7, wherein said predetermined time is of a selected value up to 10 minutes, and said flow velocity is chosen to achieve good fluidization characteristics of the coal/air stream in the said magnetic separation unit.

* * * * *